US006789728B1

(12) United States Patent
Muzzammel

(10) Patent No.: US 6,789,728 B1
(45) Date of Patent: Sep. 14, 2004

(54) OBSTETRICS MEASURE AND CALCULATOR

(76) Inventor: Mohiuddin M. Muzzammel, 11323 Bright Pond La., Reston, VA (US) 20194

( * ) Notice: Subject to any disclaimer, the term of this patent is extended or adjusted under 35 U.S.C. 154(b) by 126 days.

(21) Appl. No.: 10/262,963

(22) Filed: Oct. 3, 2002

Related U.S. Application Data

(63) Continuation-in-part of application No. 10/059,112, filed on Jan. 31, 2002, now abandoned.

(51) Int. Cl.[7] ..... G06C 3/00
(52) U.S. Cl. ..... 235/85 FC; 235/78 R
(58) Field of Search ..... 235/78 R, 78 RC, 235/88 RC, 85 FC, 116; 40/111, 113, 114, 115, 595

(56) References Cited

U.S. PATENT DOCUMENTS

| | | | | |
|---|---|---|---|---|
| 2,513,196 A | | 6/1950 | Morse | |
| 4,751,373 A | * | 6/1988 | Ivey | 235/84 |
| 5,496,070 A | | 3/1996 | Thompson | |
| 5,777,905 A | | 7/1998 | Dowdle et al. | |

* cited by examiner

*Primary Examiner*—Karl D Frech
(74) *Attorney, Agent, or Firm*—Patent & Trademark Services, Inc.; Joseph H. McGlynn

(57) ABSTRACT

A device which has two calendars on an outer surface, one indicating last menstrual date adjacent to another calendar indicating expected date of delivery. On a side of the device is a rotating wheel for weekly pregnancy calculation. Also, a measuring tape to measure the height of the uterus and which has medical data on part of the tape is included in the device.

12 Claims, 4 Drawing Sheets

OBSTETRICS MEASURE AND CALCULATOR

This application is a Continuation-In-Part of Ser. No. 10/059112, filed Jan. 31, 2002, now abandoned.

BACKGROUND OF THE INVENTION

This invention relates, in general, to obstetric devices, and, in particular, to obstetric devices which are used to calculate the gestation period.

DESCRIPTION OF THE PRIOR ART

In the prior art various types of devices have been proposed. For example, U.S. Pat. No. 2,513,196 to Morse discloses a rhythm calculator with a yearly calendar divided in months on the face of a circular case.

U.S. Pat. No. 5,496,070 to Thompson discloses a calendar monitoring system which includes a flat monitoring strip divided into months.

U.S. Pat. No. 5,777,905 to Dowdle et al discloses an electronic calculator for calculating obstetrical data.

U.S. Pat. No. 5,673,860 to Denis et al discloses a pocket sized electronic calculator for calculating gestational information.

During pregnancy, it is often desirable for the obstetrician to quickly and accurately calculate the patient's prospective birth date, as well as the approximate calendar dates for various other stages of the pregnancy. This permits the doctor and the patient to plan the patient's schedule and to, also, plan other activities during the pregnancy such as workups and ultrasound tests. Traditionally, obstetricians have performed these calculations with a revolving wheel, slide rule type apparatus, such as shown in FIG. 1.

However, conventional birth date calculators exhibit a number of disadvantages. The inner and outer scales are in small print and difficult to read. Moreover, the doctor must realign the inner wheel with the outer ring for each patient. This tedious and time consuming procedure my have to be repeated a large number of times each day, depending on the number of patients that the obstetrician sees.

In addition, the obstetrician often manipulates the birth date calendar/calculator with one hand, while holding the patient's medical chart in the other hand. As the obstetrician's attention shifts back and forth between the chart and calculator, the inner wheel on the calculator may shift out of position. Also, with use the calculator wheels become sloppy and can give the obstetrician a false reading.

Due to these factors conventional revolving calculators are prone to errors. A faulty pregnancy timetable can cause the patient to undertake undesirable activities which can pose inconvenience or a serious medical risk.

SUMMARY OF THE INVENTION

The present invention is directed to a device which has a calendar corresponding to the weekly duration of conception and date of delivery and a second calendar which is positioned to avoid unnecessary manipulation of the wheel.

It is an object of the present invention to provide a new and improved obstetric device.

It is an object of the present invention to provide a new and improved obstetric device which has a calendar for measuring the weekly duration of conception and date of delivery.

It is an object of the present invention to provide a new and improved obstetric device which has a calendar which is easier and more convenient to use.

These and other objects and advantages of the present invention will be fully apparent from the following description, when taken in connection with the annexed drawings.

DESCRIPTION OF THE PREFERRED EMBODIMENT

Figure 1:
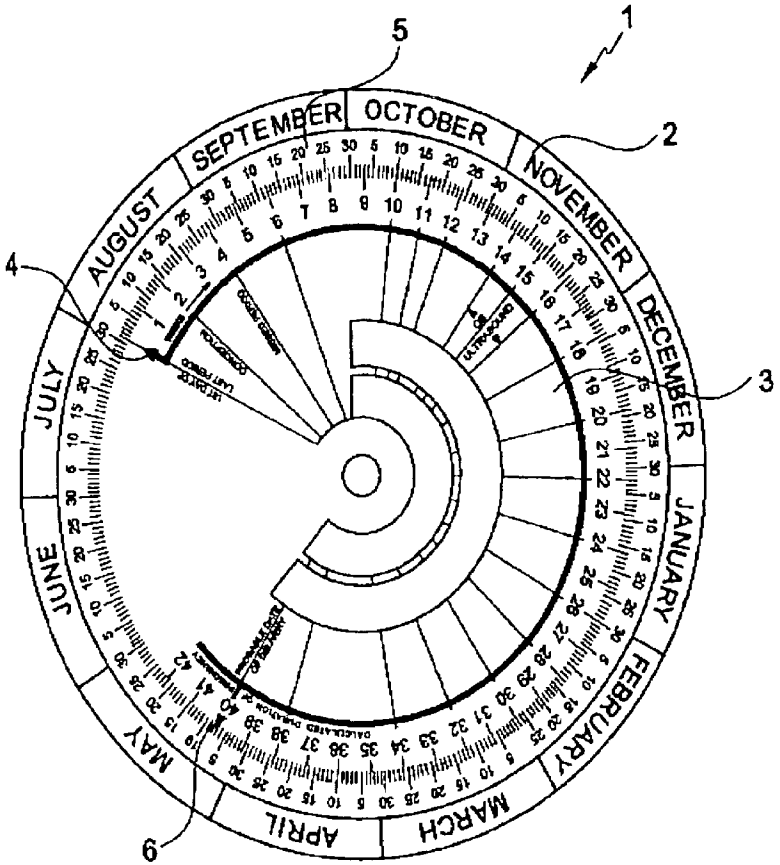
FIG.1 Prior Art
FIG. 1 is a view of the prior art obstetrics wheel calendar.

Referring now to the drawings in greater detail, FIG. 1 shows the prior art obstetrics wheel calendar 1. The wheel has a fixed calendar ring with the months 2 and the days of the month 5 printed thereon. The wheel also has a rotatably mounted circular scale 3 that has the weeks in a typical gestation period printed thereon. In addition, the scale 3 has various types of patient activities, such as Ultra Sound, Modified GGT, etc., printed on it. The scale also has a first indicating arrow 4 and a second arrow 6 affixed thereto. In use, the obstetrician rotates the wheel so the first arrow 4 points to the date on the scales 2, 5 that is the first day of the patient's last period, and the second arrow 6 will point to the date on the scales 2, 5 that is the probable date of delivery.

Figure 2:
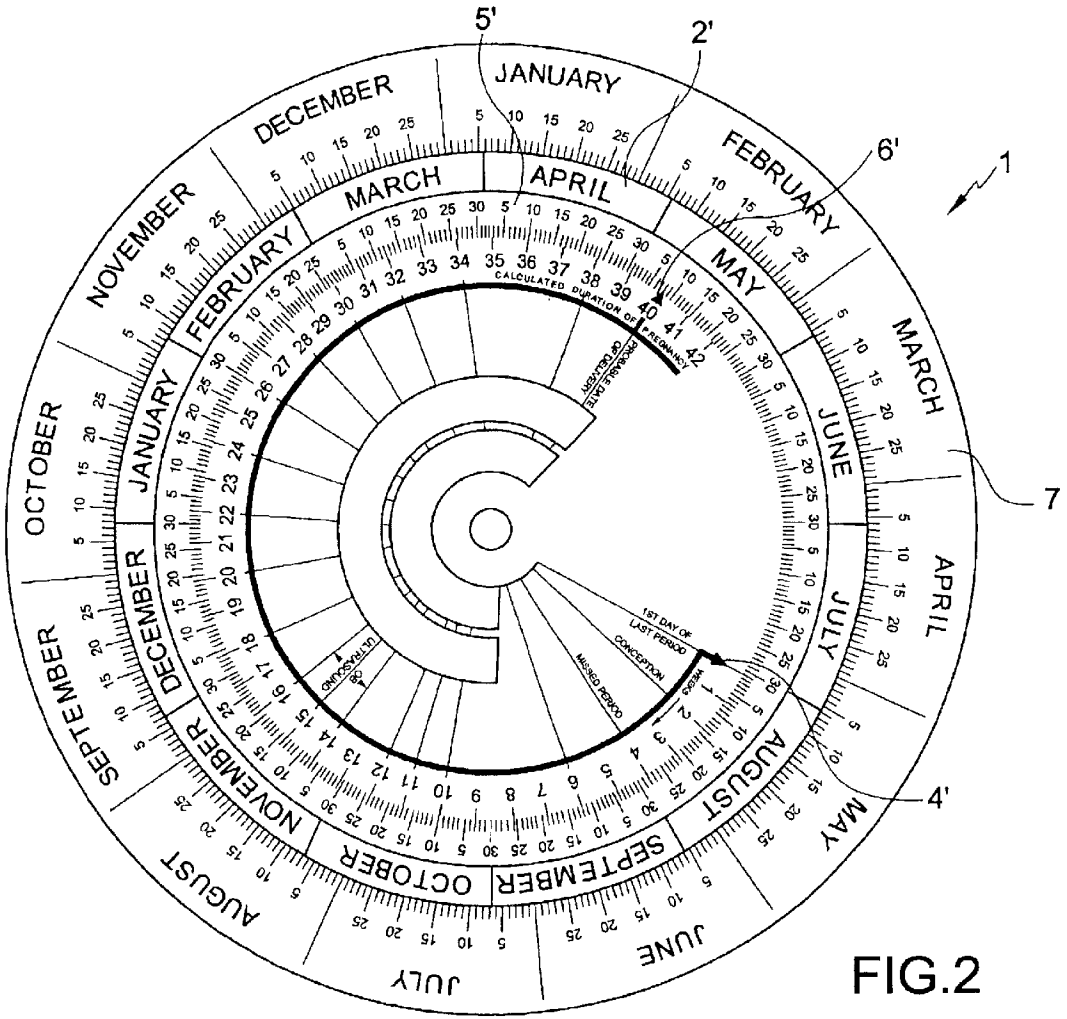
FIG. 2 is a view of the obstetrics wheel calendar of the present invention.

FIG. 2 shows the calculator wheel 1' of the present invention. The wheel has a fixed calendar ring with the months 2' and the days of the month 5' printed thereon. The wheel also has a rotatably mounted circular scale 3' that has the weeks in a typical gestation period printed thereon. In addition, the scale 3' has various types of patient activities, such as Ultra Sound, Modified GGT, etc., printed on it. The scale also has a first indicating arrow 4' and a second arrow 6' affixed thereto. In use, the obstetrician rotates the wheel so the first arrow 4' points to the date on the scales 2', 5' that is the first day of the patient's last period, and the second arrow 6' will point to the date on the scales 2, 5 that is the probable date of delivery, which is essentially the same structure and method of use as in the FIG. 1 device. However, the present invention differs from the prior art device shown in FIG. 1, in that a second scale 7 is provided on the circumference of the wheel 1'. The second scale 7 provides the months and the days, similar to the months and days 2', 5', however the scale 7 is offset so the months and days on 7 do not align with the same months and days on 2', 5'.

This offset is important since once the obstetrician sets the arrow 4' to the month and day (on scales 2', 5') of the first day of the last period, the same arrow (4') points to the month and day on scale 7 that is patient's probable day of delivery. In this manner, the obstetrician does not have to concern himself/herself with reading two different arrows (i.e. 4', 6') to determine the patient's probable day of delivery. The obstetrician merely has to set the arrow 4' on scale 2', 5' and look up to the scale 7 where the necessary information is readily apparent and available.

Figure 3:
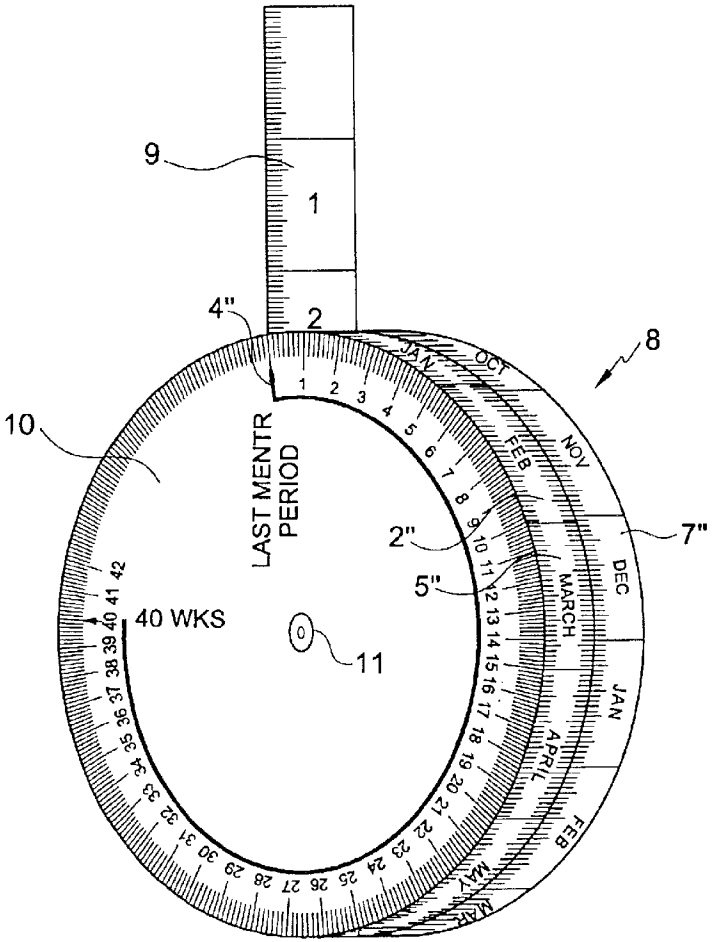
FIG. 3 is a perspective view of the present invention used with a measuring tape.

In FIG. 3, the present invention is incorporated into an obstetricians measuring tape 8 having a linear measure 9. It should be noted that the linear measure 9 is shown in inches, however, this is not critical and metric measurements could also be used. The measuring tape is normally used to measure the height of the uterus, which is normally a part of the physical examination of the patient. In FIG. 3, the measuring tape case has the scales 2", 5" and 7" positioned around the circumference of the tape case. It should be noted that the scale 5" shows the numbers as line markings, however, numbers 5, 10, etc., as shown in FIGS. 1 and 2 could also be used. The scales 2", 5" serve the same purpose as the scales 2, 5 in the FIG. 1 device, and the scales 2', 5' in the FIG. 2 device. The scale 7" serves the same purpose as the scale 7 in the FIG. 2 device.

The tape case has a side surface 10 which is rotatable about pivot point 11 with respect to the remainder of the case. The side surface 11 has an arrow 4" which will serve the same purpose as the arrow 4 in FIG. 1 and the arrow 4' in FIG. 2. In order to use the device shown in FIG. 3, the obstetrician aligns the arrow 4" with the month and day of the first day of the last period on scale 2", 5" and reads the probable date of delivery on scale 7".

Figure 4:
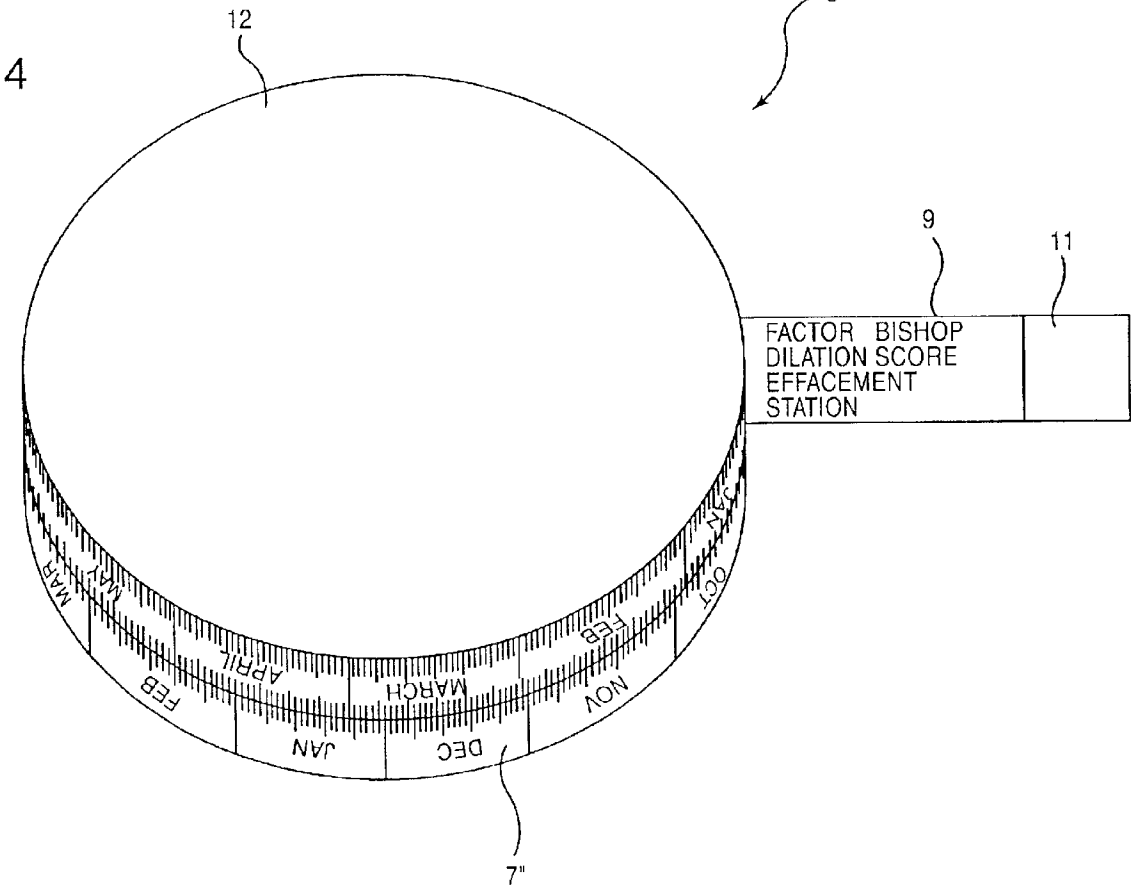
FIG. 4 is a perspective view of the reverse side of the FIG. 3 embodiment of the present invention.

FIG. 4 shows the reverse side 12 of the tape case shown in FIG. 3 and the reverse side 11 of the linear measure or tape 9. The reverse side 11 of the tape 9 has additional medical information that can be useful to an obstetrician. Also, the obstetrician can have medical data instead of the numerals placed on the front side of the tape 9.

The following are examples of the medical data that can be placed on the reverse side 11:

| | | | | | | | | | |
|---|---|---|---|---|---|---|---|---|---|
| Bishop | Factor 0 | 1 | 2 | 3 | Factor | 0 | 1 | 2 | 3 |
| Score | Dilation Closed | 1–2 cm | 3–4 cm | 5 + cm | Consistency | F | Medium | Soft | N/A |
| | Effacement | 0–30% | 40–50% | | 60–70% | 80 + % | Position | Post | Mid |
| Ant | N/A | | | | | | | | |
| | Station −3 | −2 | −1 | +1/+2 | | | | | |
| Success for Induction | | | | | | | | | |
| Score | 0–4 | 50% | | | | | | | |
| Score | 5–9 | 90% | | | | | | | |
| Score | 10–13 | 100% | | | | | | | |
| Hyper | Dramamine/Bendryl | | Phenergan | | | Zofran | | | |
| Emesis | 50 mg q 6 hr PO/PR/IM | | 12.5/25/50 mg | PO/PR/IM | | 48 mg q 6 hr PO/IM | | | |
| | cat-B Cost $ | | cat-C Cost $$ | | | cat-B Cost $$$$ | | | |
| Reglan | | | | | | | | | |
| 5/10 mg Po/OM/IV q 6 hr | | | | | | | | | |
| cat-B Cost $$(gen) | | | | | | | | | |
| Bowel | Golytely | 4 L, 12 noon–4 pm | | | | | | | |
| Prep | Flagyl | 500 mg PO 10 am & 10 pm | | | | | | | |
| | Levaquin | 500 mg PO 10 pm | | | | | | | |
| | Clear Liquid 24 HR | | | | | | | | |
| Pre | MI LD | | SEVERE | | | SEVERE | | | |
| Eclampsia | BP 140/90-110 | | BP > 160/110 | | | HELLP Syndr. | | | |
| | Proteinuria < 5 G/24 HR | | Proteinuria > 5 G/24 HR | | | IUGR/Oligohydramnios | | | |
| | | | Oliguria > 500M/24 HR | | | DIC > BUN/CR | | | |
| SEVERE | | | | | | | | | |
| Headache Blurr | | | | | | | | | |
| Vision, Plum, Edema | | | | | | | | | |
| Cyanosis, RUQ Pain | | | | | | | | | |
| Scalp blood | pH | pCO mmHg | pO mmHg g | | | | | | |
| Stage 1 | 7.34–7.40 | 36–54 | 20–24 | | | | | | |
| Stage 2 | 7.26–7.42 | 36–60 | 20–24 | | | | | | |
| Cord blood | pH | pCO mmHg | pO mmHg l | | | | | | |
| Artery | 7.22–7.34 | 32–64 | 14–22 | | | | | | |
| Vein | 7.29–7.41 | 25–53 | 23–35 | | | | | | |

It should be noted that the above medical data is merely examples of the type of data that can be placed on the tape 9. Other data could be instead of or in addition to the data above.

By applying the various scales to the measuring tape 8, the obstetrician has fewer tools to juggle while performing an examination, thereby making his/her job easier.

Although the Obstetrics Measure and Calculator and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A pregnancy date monitoring device comprising:

a first scale having different months placed thereon, a second scale having days of the month for each of said different months placed thereon, a third scale having different months and having days of the month for each of said different months placed thereon, a single movable indicator means for selecting a first day of a last period of a patient on said first and second scales, and said single movable indicator means also indicating a probable day of delivery on said third scale.

2. The pregnancy date monitoring device as claimed in claim 1, wherein said pregnancy date monitoring device also has another movable indicator means for indicating a probable day of delivery on said first and second scales.

3. The pregnancy date monitoring device as claimed in claim 1, wherein a selected month on said first scale is not aligned with a similar month on said third scale.

4. A pregnancy date monitoring device comprising:

a first scale having different months placed thereon, a second scale having days of the month for each of said different months placed thereon, a third scale having different months and having days of the month for each of said different months placed thereon, a single movable indicator means for selecting a first day of a last period of a patient on said first and second scales, and said single movable indicator means also indicating a probable day of delivery on said third scale, and wherein said pregnancy date monitoring device has a case, and a measuring tape is positioned within said case.

5. The pregnancy date monitoring device as claimed in claim 4, wherein said measuring tape is a linear measuring tape marked in centimeters and inches to measure the height of the uterus.

6. The pregnancy date monitoring device as claimed in claim 4, wherein said first and second scales are positioned on a circumference of said case.

7. The pregnancy date monitoring device as claimed in claim 4, wherein said third scale is positioned on a circumference of said case.

8. The pregnancy date monitoring device as claimed in claim 4, wherein said single movable indicator means is positioned on a side of said case.

9. The pregnancy date monitoring device as claimed in claim 4 wherein said measuring tape has a first side and a second side, and said first side has medical data thereon, and said reverse side has medical data thereon.

10. The pregnancy date monitoring device as claimed in claim 4, wherein said measuring tape has a first side and a second side, and said first side has linear marking thereon, and said reverse side has medical data thereon.

11. The pregnancy date monitoring device as claimed in claim 10, wherein said measuring tape can be pulled out of said case so said linear markings and said medical data can be observed.

12. A pregnancy date monitoring device comprising:

a first scale having different months placed thereon, a second scale having days of the month for each of said different months placed thereon, a third scale having different months and having days of the month for each of said different months placed thereon, a single movable indicator means for selecting a first day of a last period of a patient on said first and second scales, and said single movable indicator means also indicating a probable day of delivery on said third scale, and wherein said pregnancy date monitoring device also has another movable indicator means for indicating a probable day of delivery on said first and second scales, and wherein said another movable indicator means is for weekly calculation of pregnancy.

* * * * *